US007442098B2

(12) United States Patent
Uchida et al.

(10) Patent No.: US 7,442,098 B2
(45) Date of Patent: Oct. 28, 2008

(54) METHOD OF FIXING TERMINAL FITTING COMPONENTS TO EACH OTHER AND TERMINAL FITTING

(75) Inventors: Jun Uchida, Shizuoka (JP); Masakuni Samejima, Shizuoka (JP); Isanori Shimizu, Shizuoka (JP); Tamio Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/476,135

(22) Filed: Jun. 28, 2006

(65) Prior Publication Data

US 2007/0049132 A1 Mar. 1, 2007

(30) Foreign Application Priority Data

Aug. 31, 2005 (JP) ..... 2005-252838

(51) Int. Cl.
*H01R 4/10* (2006.01)

(52) U.S. Cl. ..... 439/877; 439/883

(58) Field of Classification Search ..... 439/870, 439/877, 883

See application file for complete search history.

(56) References Cited

U.S. PATENT DOCUMENTS 1,798,812 A * 3/1931 Rosenbeck ..... 439/814
2,061,961 A * 11/1936 Culver et al. ..... 439/742
2,074,810 A * 3/1937 Sabol ..... 439/877
2,962,693 A * 11/1960 Ott ..... 439/849
2,990,533 A * 6/1961 Hughes et al. ..... 439/84
3,097,258 A * 7/1963 Modrey ..... 439/790
3,514,739 A * 5/1970 Jamon ..... 439/823
4,218,109 A * 8/1980 Kneusels ..... 439/620.26
4,457,573 A * 7/1984 Bailey et al. ..... 439/557
4,598,971 A * 7/1986 Goodman ..... 439/726
5,002,508 A * 3/1991 Craveiro ..... 439/759
5,801,335 A * 9/1998 Brussalis et al. ..... 439/949
5,865,638 A * 2/1999 Trafton ..... 439/927

* cited by examiner

*Primary Examiner*—Briggitte R Hammond
(74) *Attorney, Agent, or Firm*—Kratz, Quintos & Hanson, LLP

(57) ABSTRACT

A terminal fitting includes first and second terminal fitting components. The first terminal fitting component includes a first flat plate having a through hole and caulking pieces. The caulking pieces stand up from both edges in the width direction of the first flat plate. The second terminal fitting component includes a second flat plate having a projection. The projection is inserted in the through hole, an end part of the projection is crushed, and the second flat plate is caulked with the caulking pieces so that the first and second terminal fitting components are fixed to each other, thereby obtaining the terminal fitting.

2 Claims, 9 Drawing Sheets

METHOD OF FIXING TERMINAL FITTING COMPONENTS TO EACH OTHER AND TERMINAL FITTING

BACKGROUND OF THE INVENTION (1) Field of the Invention

The present invention relates to a method of fixing terminal fitting components to each other and a terminal fitting which composes a wiring harness to be mounted on a motor vehicle and so on.

(2) Description of the Related Art

Various electronic instruments are mounted on a motor vehicle as a mobile unit. The motor vehicle is equipped with a wiring harness to transmit electric power and control signals to the electronic instruments. The wiring harness includes a plurality of electric wires and connectors. The electric wire is the so-called coated electric wire, which includes an electrically conductive core wire and an electrically insulating coating that coats the core wire.

The connector includes a terminal fitting and connector housing. The terminal fitting consists of an electrically conductive metal plate. The connector housing is made of electrically insulating synthetic resin and formed in a tube-shape. The connector housing receives the terminal fitting therein.

For example, the connector fits to a mating connector in a state that the connector is attached to a printed wiring board. A terminal fitting for such a type of connector includes a first electric contacting part having a rod-shape for electrically connecting to a wiring pattern of the printed wiring board and a second electric contacting part having a tube-shape for connecting to a terminal fitting of the mating connector.

In the terminal fitting that includes the first electric contacting part having a rod-shape and the second electric contacting part having a tube-shape, since a cross-sectional area of the first electric contacting part is different from that of the second electric contacting part, the first electric contacting part generates heat locally when a current is applied.

In order to prevent the heat generation, it may be considered that the first electric contacting part is formed by bending so as to increase the cross-sectional area of the first electric contacting part. However, in such a case, a mold for forming the first electric contacting part by bending is forced to be complicated, causing the cost of the terminal fitting itself to increase.

Further, it may be considered that the terminal fitting is composed of a first terminal fitting component having the first electric contacting part and a second terminal fitting component having the second electric contacting part, wherein the first and second terminal fitting components are not formed in one piece, thereby allowing a thickness of the first terminal fitting component to be larger than that of the second terminal fitting component, thereby preventing the heat generation of the first electric contacting part (i.e. the heat generation of the first terminal fitting component) from occurring.

In the above case, it may be considered that one of the first and second terminal fitting components is provided with a spring piece in order to fix the first and second terminal fitting components to each other. However, in such a case, a structure of said one of the first and second terminal fitting components having the spring piece is forced to be complicated, therefore a mold for forming said one terminal fitting component by bending is forced to be complicated, causing the cost of the terminal fitting itself to increase.

Further, it may be considered that a rivet that is not formed in one piece with the first and second terminal fitting components is used in order to fix the first and second terminal fitting components to each other. However, in such a case, the number of parts tends to increase, causing the cost of the terminal fitting itself to increase.

SUMMARY OF THE INVENTION

It is therefore an objective of the present invention to solve the above problems and to provide an inexpensive method of fixing terminal fitting components to each other and a terminal fitting, by which local heat generation can be prevented from occurring.

In order to attain the above objective, the present invention is to provide a method of fixing a first terminal fitting component having a first flat plate and a second terminal fitting component having a second flat plate to each other including the steps of:

inserting a projection projecting from the second flat plate into a through hole formed in the first flat plate; and crushing an end part of the projection toward the second flat plate to form an enlarged part, thereby holding the first flat plate between the enlarged part and the second flat plate.

According to the method described above, with a simple construction in which the first flat plate is provided with the through hole and the second flat plate is provided with the projection, the first and second flat plates can be fixed to each other, that is, the first and second terminal fitting components can be fixed to each other.

Therefore, the cost of the terminal fitting can be reduced even if the first terminal fitting component is separated from the second terminal fitting component and their values of thickness are set different from each other in order to prevent the heat generation from occurring.

The present invention is also to provide a terminal fitting including:

a first terminal fitting component having a first flat plate; and a second terminal fitting component having a second flat plate; wherein the first and second terminal fitting components are fixed to each other on a condition that the first and second flat plates are placed one upon another, the first flat plate having a through hole, and the second flat plate having a projection projecting from the second flat plate, the projection being inserted in the through hole, wherein an enlarged part is formed by crushing an end part of the inserted projection toward the second flat plate, so that the first flat plate is held between the enlarged part and the second flat plate.

According to the construction described above, with a simple construction in which the first flat plate is provided with the through hole and the second flat plate is provided with the projection, the first and second flat plates can be fixed to each other, that is, the first and second terminal fitting components can be fixed to each other.

Therefore, the cost can be reduced even if the first terminal fitting component is separated from the second terminal fitting component and their values of thickness are set different from each other in order to prevent the heat generation from occurring.

Preferably, a plurality of the through holes and a plurality of the projections are provided.

With the construction described above, the first and second terminal fitting components can be fixed to each other without looseness. Therefore, these terminal fitting components can be prevented from being assembled by bending themselves.

Preferably, an inner surface of the through hole is provided with a tapered surface inclined in a direction in which the through hole is gradually enlarged as leaving from the second flat plate placed on the first flat plate.

With the construction described above, the end part of the projection can be securely positioned within the through hole, therefore the enlarged part formed by crushing the end part of the projection expands in an outer peripheral direction within the through hole.

Therefore, the first flat plate can be securely held between the enlarged part and the second flat plate. Therefore, the first and second terminal fitting components can be securely firmly fixed to each other, thereby preventing these terminal fitting components from being abruptly separated from each other.

Preferably, the inner surface of the through hole is further provided with a parallel surface that is located nearer to the second flat plate than the tapered surface is located, the parallel surface continuing to the tapered surface and facing with an outer peripheral surface of the projection before formation of the enlarged part having a distance therebetween.

With the construction described above, the projection can be easily inserted into the through hole. Therefore, the terminal fitting components can be easily fixed to each other and the terminal fitting can be easily assembled.

Preferably, the enlarged part comes in closely contact with the tapered surface so as to be received in the through hole.

With the construction described above, the first flat plate can be securely held between the enlarged part and the second flat plate. Further, since the enlarged part is received within the through hole, therefore the enlarged part can be prevented from coming in contact with another article.

Therefore, the first flat plate can be securely held between the enlarged part and the second flat plate. Therefore, the first and second terminal fitting components can be securely firmly fixed to each other, thereby preventing these terminal fitting components from being abruptly separated from each other.

Since the enlarged part can be prevented from coming in contact with another article, therefore a short circuit can be prevented from occurring.

Preferably, a projection length of the projection from the second flat plate before formation of the enlarged part is approximately equal to a thickness of the first flat plate, and a recess on an end surface of the end part of the projection as well as the enlarged part are formed by crushing a center of the end surface toward the second flat plate.

With the construction described above, the enlarged part more securely adheres to the tapered surface. Therefore, an electric resistance between the terminal fitting components fixed to each other can be reduced. Further, since the first flat plate can be more firmly held between the enlarged part and the second flat plate, therefore the terminal fitting components can be more firmly fixed to each other.

DESCRIPTION OF THE PREFERRED EMBODIMENTS

In the following, a terminal fitting according to the first preferred embodiment of the present invention is explained with reference to FIGS. 1-7. A terminal fitting 1 shown in FIG. 1 and the other figures constructs a connector (not shown in the figure).

The connector includes a connector housing made of electrically insulating synthetic resin and the terminal fitting 1. The connector housing is formed in a box-shape and has many terminal-receiving chambers for receiving the terminal fittings 1. The connector housing is attached to a printed wiring board and fits to a connector housing of a mating connector.

Figure 1:
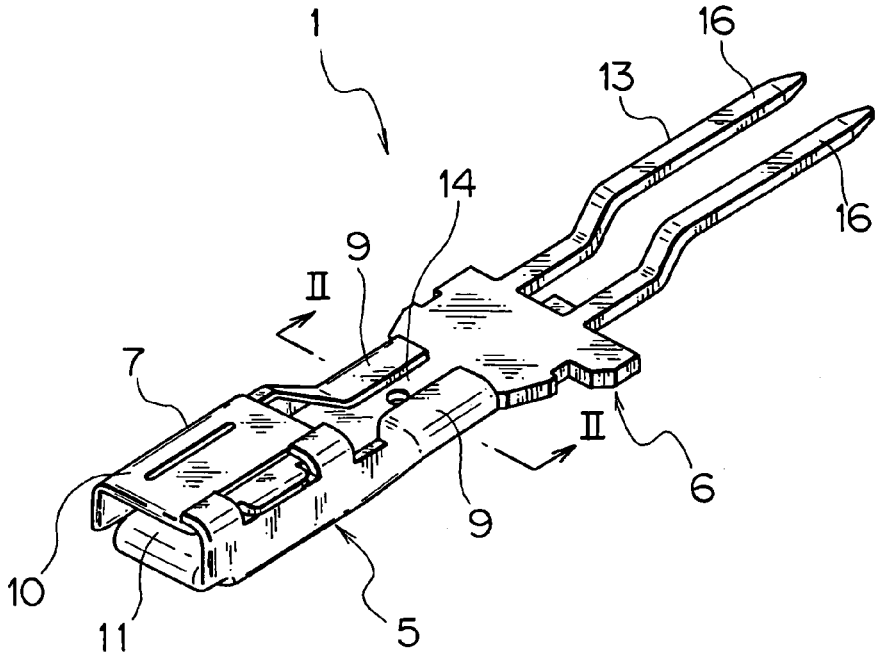
FIG. 1 is a perspective view illustrating a terminal fitting according to the first preferred embodiment of the present invention.
Figure 2:
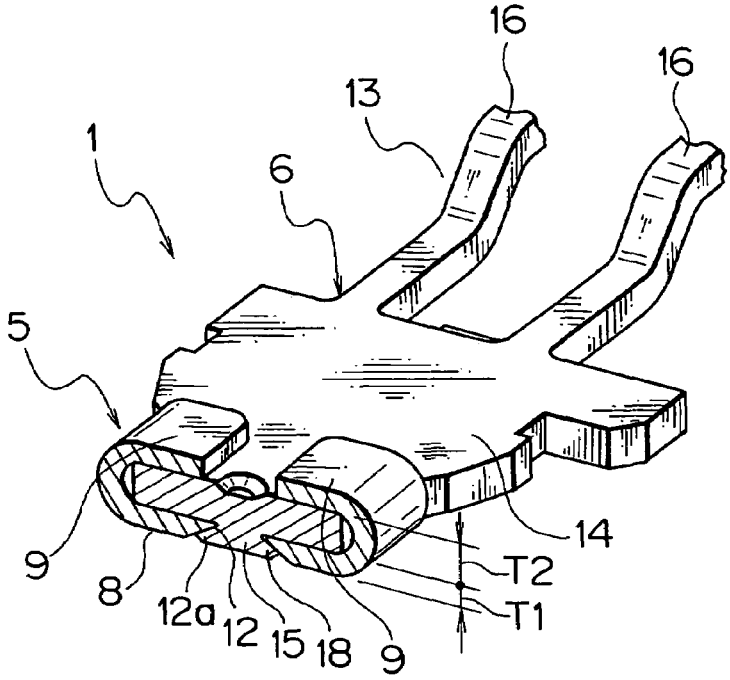
FIG. 2 is a perspective view illustrating a cross section taken along II-II line in FIG. 1.

As shown in FIGS. 1 and 2, the terminal fitting 1 includes a first terminal fitting component 5 and a second terminal fitting component 6.

Figure 3:
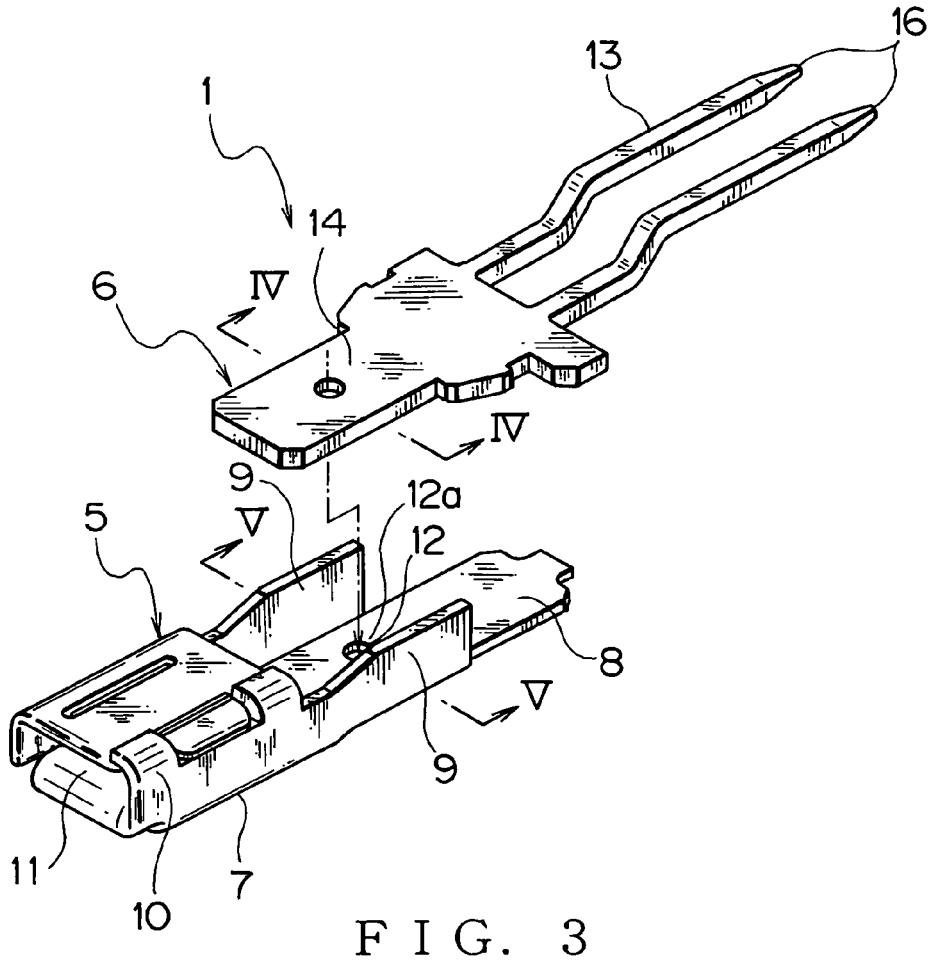
FIG. 3 is an exploded perspective view illustrating a terminal fitting shown in FIG. 1.

The terminal fitting 1 is made of electrically conductive metal plate and includes integrally a first electric contact part 7, first flat plate 8 and a pair of caulking pieces 9 as shown in FIG. 3. The first electric contact part 7 includes a tube part 10 formed in a quadrilateral tube-shape and a spring piece 11 formed in the tube part 10. A male tab of a terminal fitting of a mating connector enters into the tube part 10, i.e. into the first electric contact part 7. The spring piece 11 presses the male tab entered in the tube part 10 onto an inner surface of the tube part 10. The first electric contact part 7 is electrically connected to the terminal fitting of the mating connector.

The first flat plate 8 is formed in a flat plate-shape and continues integrally to one outer wall of the tube part 10 of the first electric contact part 7. The caulking pieces 9 stand up from both edges in the width direction of the first flat plate 8. The caulking piece 9 is bent toward the first flat plate 8 and a second flat plate 14 (explained later on) is held between the first flat plate 8 and the caulking piece 9. The caulking piece 9 caulks the second flat plate 14 of the second terminal fitting component 6 between the first flat plate 8 and the caulking piece 9.

Figure 5:
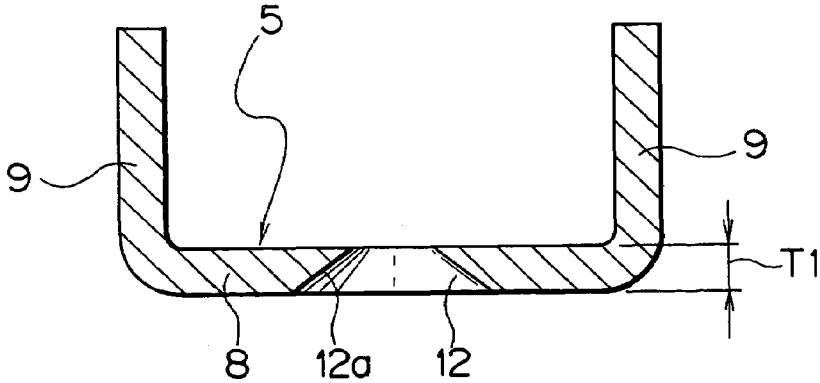
FIG. 5 is a cross sectional view taken along V-V line in FIG. 3.

The first flat plate 8 has a through hole 12 formed in a round shape in a plan view. As shown in FIG. 5, the through hole 12 has a tapered surface 12*a* inclined in a direction in which an inner diameter of the through hole 12 is gradually enlarged as leaving from the second flat plate 14 placed on the first flat plate 8. The tapered surface 12*a* is formed over the whole of the inner peripheral surface of the through hole 12.

The second terminal fitting component 6 is made of electrically conductive metal plate and includes integrally a second electric contact part 13, second flat plate 14 and a projection 15 as shown in FIG. 3. The second electric contact part 13 has a pair of terminals 16 each formed in a bar-shape. The terminals 16 are arranged in parallel to each other. The pair of the terminals 16 is passed into a through hole formed in a printed wiring board and fixed to a wiring pattern of the printed wiring board by brazing using solder or the like. The pair of the terminals 16, i.e. the second electric contact part 13 is electrically and mechanically connected to the wiring pattern of the printed wiring board.

The second flat plate 14 is formed in a flat plate-shape and the pair of the terminals 16 of the second electric contact part 13 extends from one end in the longitudinal direction of the second flat plate 14. Both main surfaces of the second flat plate 14 are parallel to the longitudinal direction of the pair of the terminals 16. The second flat plate 14 is placed on the first flat plate 8.

The projection 15 projects from a surface of the second flat plate 14, on which surface the second flat plate 14 is placed on the first flat plate 8. An outer diameter of the projection 15, which is formed in a cylindrical shape, is about the same as an inner diameter of the through hole 12 on the side of its small diameter. An enlarged part 18 is formed by crushing one end part of the inserted projection 15 toward the second flat plate 14, the one end part being an end part that is away from the second flat plate 14. The enlarged part 18 projects toward an outer peripheral direction of the projection 15. The enlarged part 18 closely comes in contact with the tapered surface 12*a*, so that the first flat plate 8 is held between the second flat plate 14 and the enlarged part 18.

A projection length D (shown in FIG. 4) of the projection 15 from the second flat plate 14 before the enlarged part 18 is formed is larger than a thickness T1 (shown in FIG. 5) of the first flat plate 8 of the first terminal fitting component 5. The projection length D is set to be such a value that when the enlarged part 18 is formed, the enlarged part 18, i.e. projection 15 is received within the through hole 12. The projection 15 having a cylindrical shape is formed by pressing out a part of the second flat plate 14.

A thickness T2 (shown in FIG. 4) of the second flat plate 14 of the second terminal fitting component 6 is larger than the thickness T1, thereby preventing local heat generation of the terminal fitting 1 from occurring, that is, preventing the terminals 16 and so on from generating heat due to an applied current.

Figure 4:
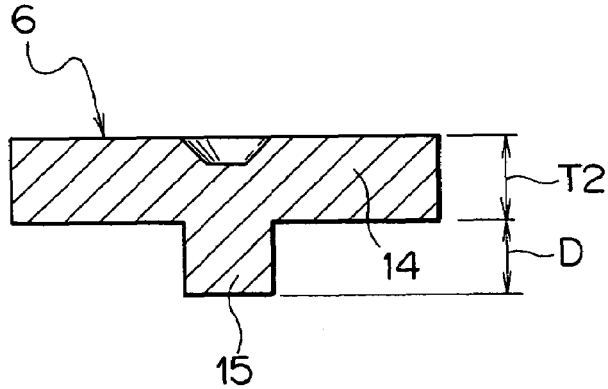
FIG. 4 is a cross sectional view taken along IV-IV line in FIG. 3.

The terminal fitting 1 is assembled in the following manner. First, as shown in FIG. 5, the through hole 12 is formed in the first flat plate 8 and the caulking pieces 9 are formed standing up from the edges in the width direction of the first flat plate 8. Further, as shown in FIG. 4, the cylinder-shaped projection 15 is formed on the second flat plate 14.

Figure 6:
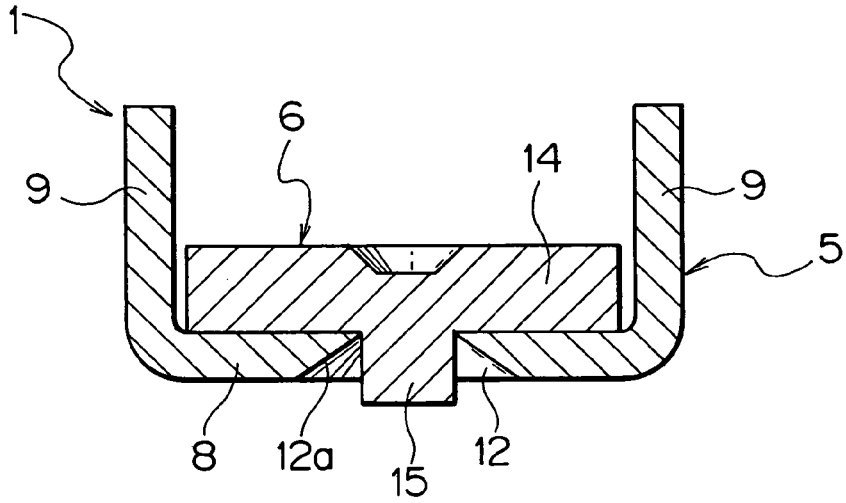
FIG. 6 is a cross sectional view illustrating a state when a projection of the second terminal fitting component is inserted in a through hole of the first terminal fitting component shown in FIG. 5.

Then, as shown in FIG. 6, the projection 15 is inserted in the through hole 12 so that the second flat plate 14 is placed on the first flat plate 8. At that time, the second flat plate 14 and the first flat plate 8 are positioned to each other so that the inner diameter of the through hole 12 gradually increases as leaving from the second flat plate 14.

Figure 7:
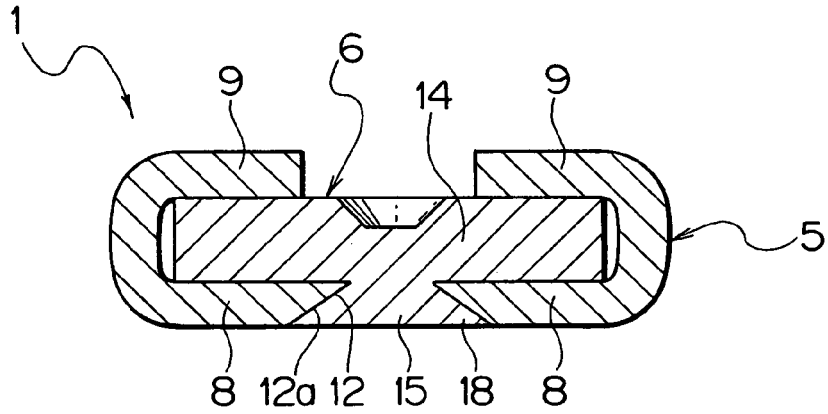
FIG. 7 is a cross sectional view illustrating a state when a caulking piece of the first terminal fitting component shown in FIG. 6 is bent so that an end part of the projection of the second terminal fitting component is crushed.

Thereafter, as shown in FIG. 7, the caulking pieces 9 are bent toward the first flat plate 8 so that the second flat plate 14 is held (i.e. caulked) between the caulking piece 9 and the first flat plate 8. An end part of the projection 15, which end part is situated away from the second flat plate 14 and projects from the through hole 12, is crushed toward the second flat plate 14 so as to form the enlarged part 18, so that the first flat plate 8 is held between the enlarged part 18 and the second flat plate 14.

Thus, the first and second terminal fitting components 5, 6 are fixed to each other, so that the terminal fitting 1 is assembled. The assembled terminal fitting 1 is received in a terminal-receiving chamber 4 of a connector housing 3, the terminal 16 of the second electric contact part 13 is connected to a wiring pattern formed on a printed wiring board, and the first electric contact part 7 is connected to a terminal fitting of a mating connector.

According to the first preferred embodiment, with a simple construction in which the first flat plate 8 is provided with the through hole 12 and the second flat plate 14 is provided with the projection 15, the first and second flat plates 8, 14 can be fixed to each other, that is, the first and second terminal fitting components 5, 6 can be fixed to each other.

Therefore, the cost of the terminal fitting 1 can be reduced even if the first terminal fitting component 5 is separated from the second terminal fitting component 6, and the thickness T1 and the thickness T2 are set different from each other in order to prevent the heat generation from occurring.

Since the tapered surface 12*a* is formed on the inner peripheral surface of the through hole 12, the enlarged part 18 expands in the outer peripheral direction within the through hole 12. Therefore, the first flat plate 8 can be securely held between the enlarged part 18 and the second flat plate 14. That is, the first and second terminal fitting components 5, 6 can be securely firmly fixed to each other, thereby preventing the first and second terminal fitting components 5, 6 from abruptly separating from each other.

Since the enlarged part 18 closely comes in contact with the tapered surface 12*a*, the first flat plate 8 can be securely held between the enlarged part 18 and the second flat plate 14. Therefore, the first and second terminal fitting components 5, 6 can be securely firmly fixed to each other, thereby preventing the first and second terminal fitting components 5, 6 from abruptly separating from each other.

Since the enlarged part 18 is received within the through hole 12, the enlarged part 18 is prevented from coming in contact with another article. That is, the terminal fitting 1 is prevented from having a short circuit.

Since the first flat plate 8 has the caulking pieces 9 for holding the second flat plate 14 against the first flat plate 8, therefore the first and second flat plates 8, 14 can be securely fixed to each other, that is, the first and second terminal fitting components 5, 6 can be securely fixed to each other.

Since the caulking pieces 9 are formed at both edges in the width direction of the first flat plate 8, therefore the first and second flat plates 8, 14 can be more securely fixed to each other, that is, the first and second terminal fitting components 5, 6 can be more securely fixed to each other.

In the following, a terminal fitting according to the second preferred embodiment of the present invention is explained with reference to FIGS. 8-10.

Figure 10:
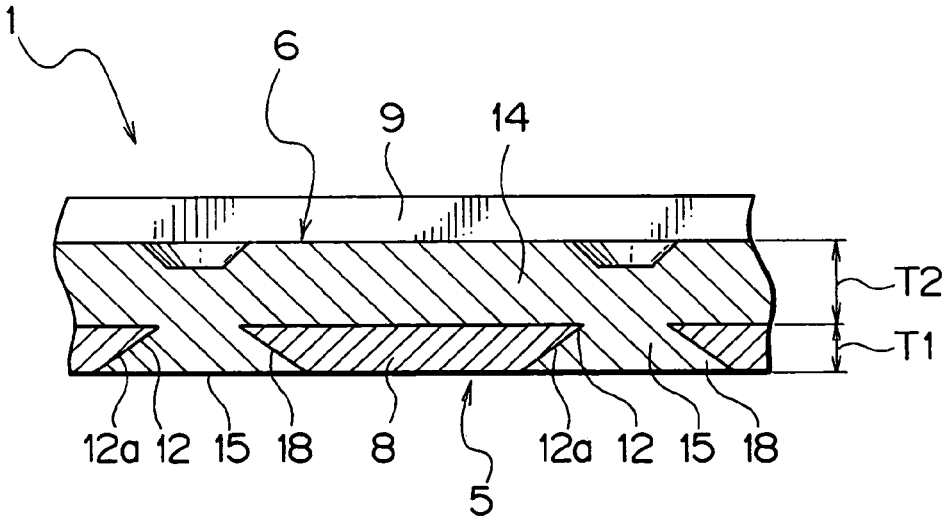
FIG. 10 is a cross sectional view taken along X-X line in FIG. 8.
Figure 8:
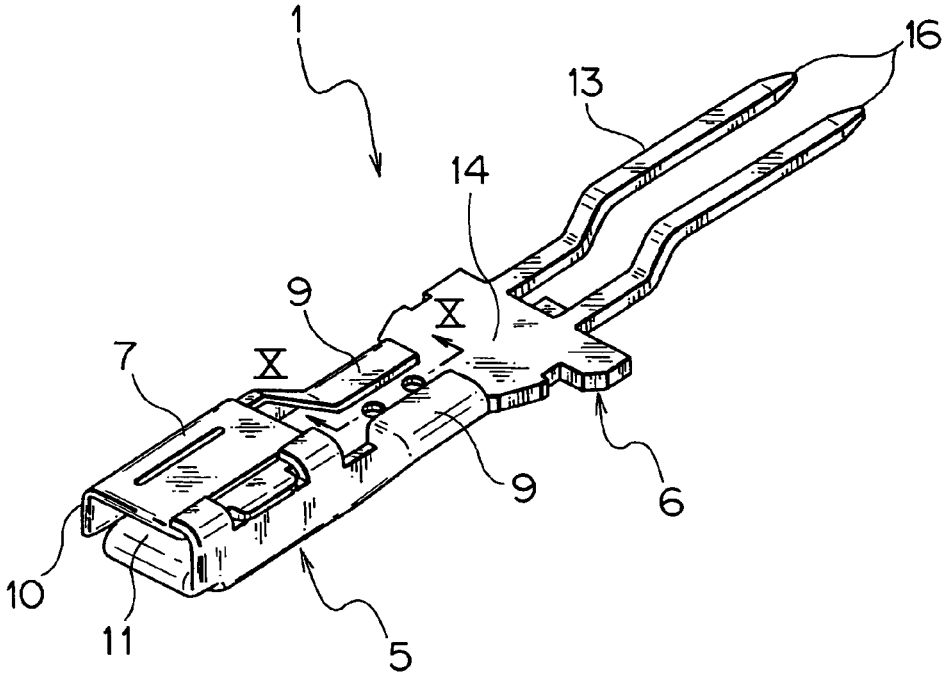
FIG. 8 is a perspective view illustrating a terminal fitting according to the second preferred embodiment of the present invention.
Figure 9:
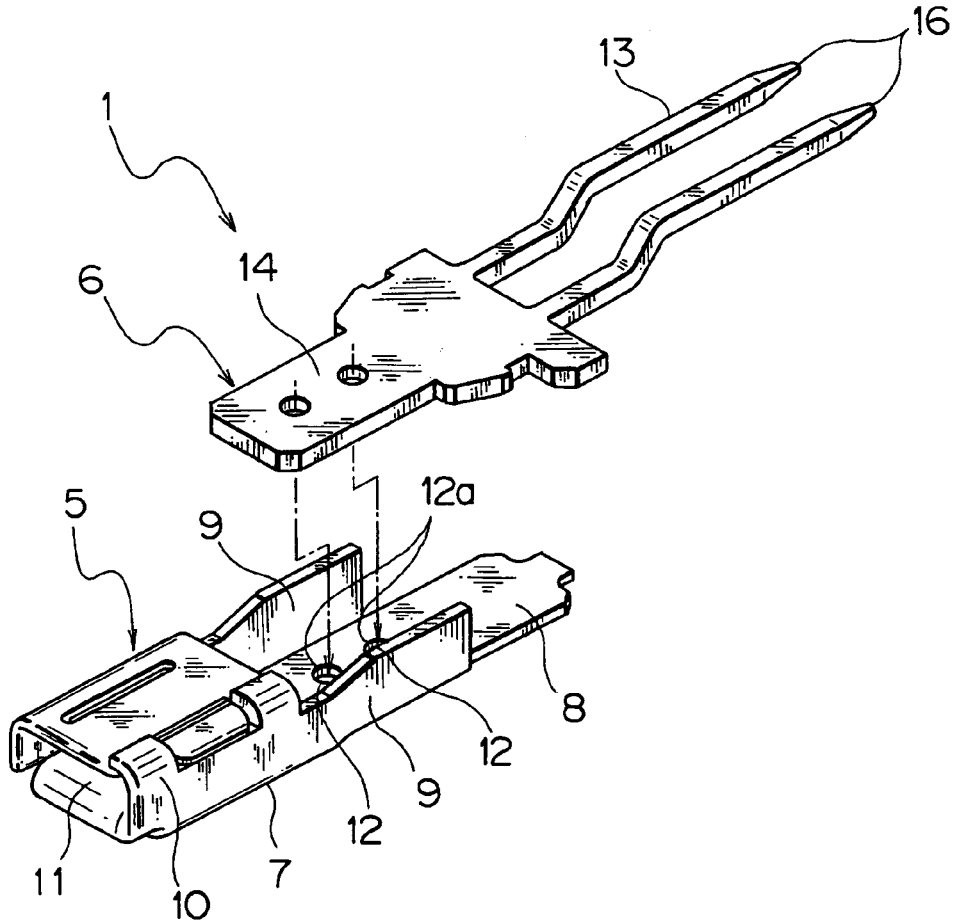
FIG. 9 is an exploded perspective view illustrating a terminal fitting shown in FIG. 8.
Figure 11:
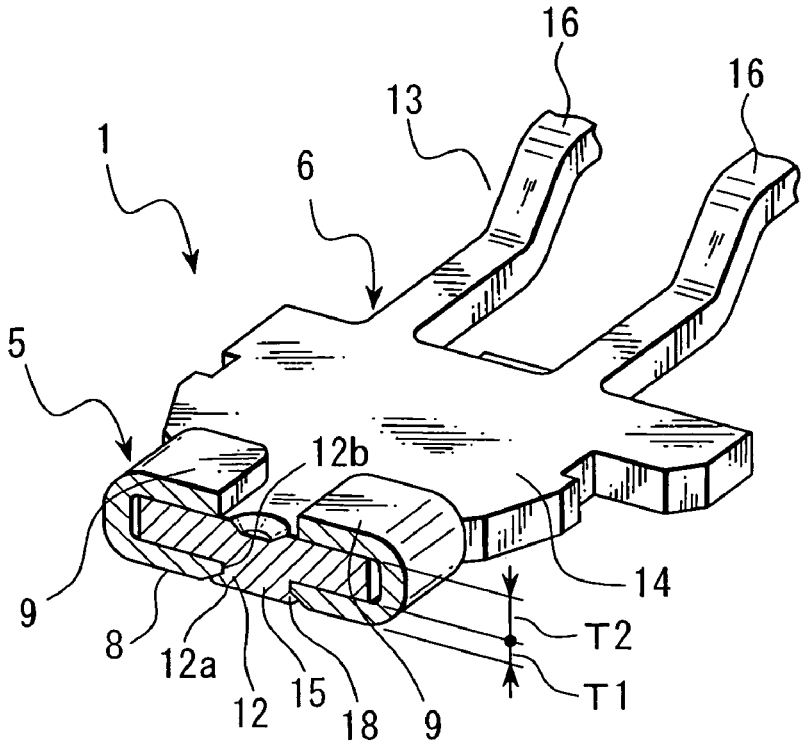
FIG. 11 is a perspective view illustrating a section of a terminal fitting according to the third preferred embodiment of the present invention.
Figure 12:
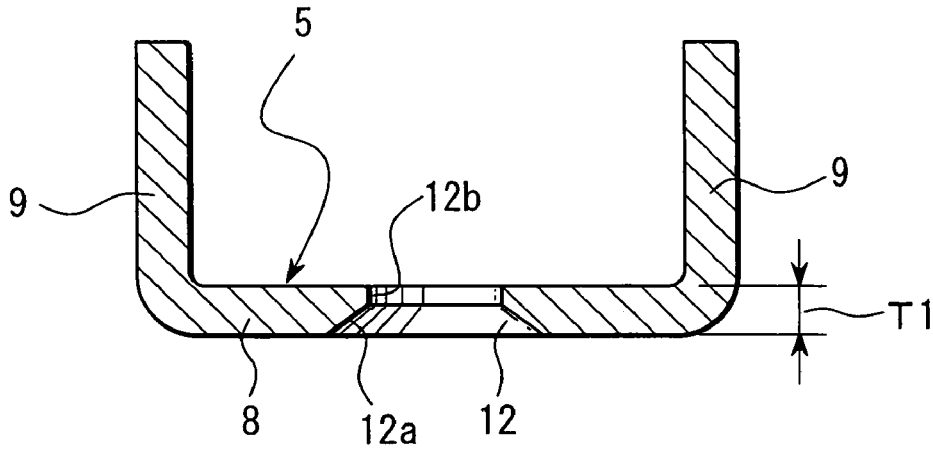
FIG. 12 is a cross sectional view of a first terminal fitting component of the terminal fitting shown in FIG. 11.
Figure 13:
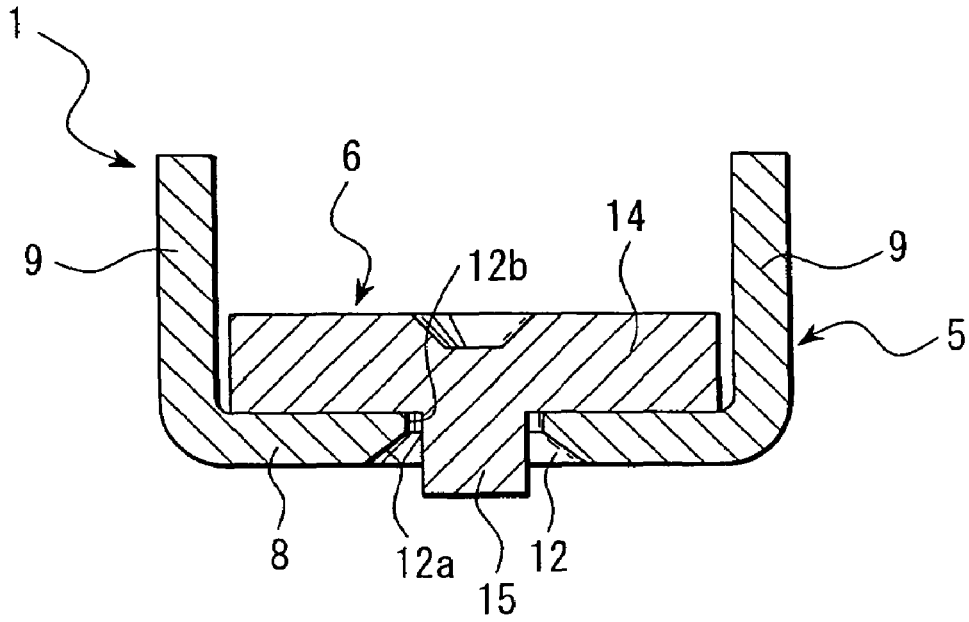
FIG. 13 is a cross sectional view illustrating a state when an enlarged part before formation of an enlarged part of the terminal fitting shown in FIG. 11 is inserted in a through hole.
Figure 14:
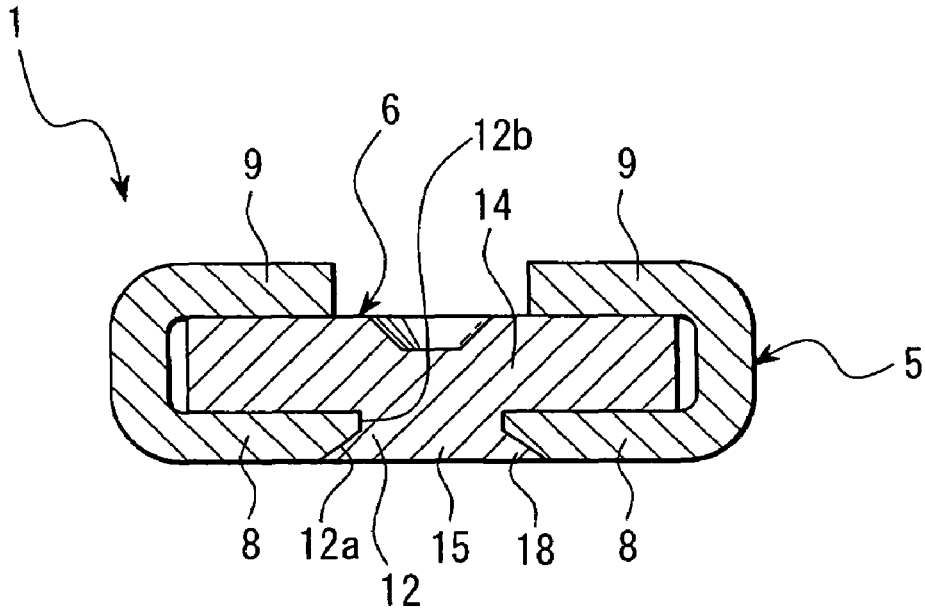
FIG. 14 is a cross sectional view illustrating a state when an end part of the projection is crushed by bending a caulking piece shown in FIG. 12.
Figure 15:
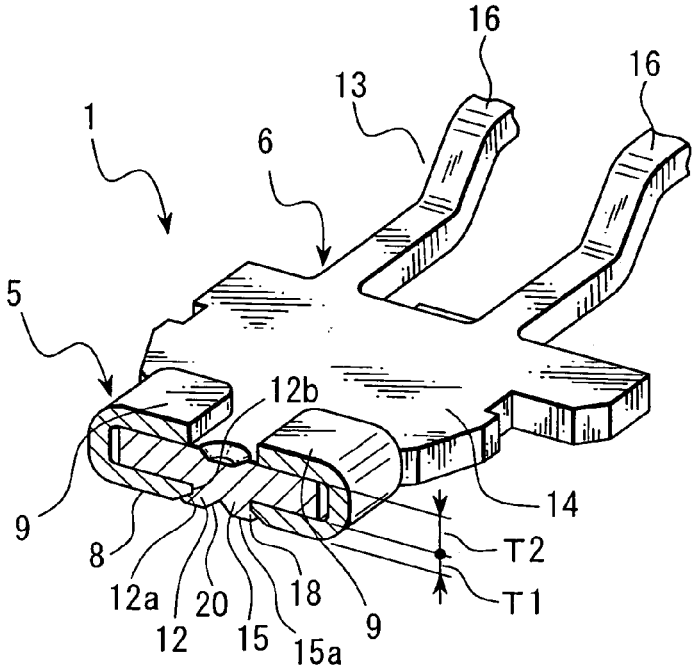
FIG. 15 is a perspective view illustrating a section of a terminal fitting according to the fourth preferred embodiment of the present invention.

As shown in FIGS. 8-10, a terminal fitting 1 according to the second preferred embodiment includes a plurality of through holes 12 and a plurality of projections 15. In an example shown in the figures, two through holes 12 and two projections 15 are formed. The two through holes 12 are arranged having a distance therebetween along the longitudinal direction of the first flat plate 8 of the first terminal fitting component 5. The two projections 15 are arranged having a distance therebetween along the longitudinal direction of the second flat plate 14 of the second terminal fitting component 6. The through hole 12 and the projection 15 according to the second preferred embodiment have the same respective structures as those of the through hole 12 and the projection 15 according to the first preferred embodiment.

According to the second preferred embodiment, since a plurality of the through holes 12 and a plurality of the projections 15 are provided, therefore the first and second terminal fitting components 5, 6 can be securely fixed to each other without looseness, thereby securely preventing the terminal fitting components 5, 6 from being abruptly separated from each other.

In the first and second preferred embodiments, the inner diameter of the through hole 12 on the side of its small diameter is made to be about the same with the outer diameter of the projection 15 before the enlarged part 18 is formed. However, in the present invention, the inner diameter of the through hole 12 on the side of its small diameter may be made larger than the outer diameter of the projection 15 before the enlarged part 18 is formed.

In the following, a terminal fitting according to the third preferred embodiment of the present invention is explained with reference to FIGS. 11-14. As for the terminal fitting 1 of the third preferred embodiment, an inner diameter of a through hole 12 is made larger than an outer diameter of a projection 15 before formation of an enlarged part 18.

In this preferred embodiment, as shown in FIGS. 11-14, in addition to a tapered surface 12*a*, a parallel surface 12*b* is formed on an inner peripheral surface (inner surface) of the through hole 12. The parallel surface 12*b* extends along a direction crossing at right angles with respect to both surfaces of the second flat plate 14. The parallel surface 12*b* continues to the tapered surface 12*a* and is located nearer to the second flat plate 14, which is placed on the first flat plate, than the tapered surface 12*a* is located. Further, the parallel surface 12*b* faces with an outer peripheral surface of the projection 15 before formation of the enlarged part 18, which enters in the through hole 12, having a distance therebetween.

According to this preferred embodiment, in addition to the effect of the first preferred embodiment, since the inner diameter of the through hole 12 is made larger than the outer diameter of a projection 15, therefore the projection 15 can be easily inserted into the through hole 12. Therefore, the terminal fitting components 5 and 6 can be easily fixed to each other and the terminal fitting 1 can be easily assembled.

Similarly to the second preferred embodiment, in this preferred embodiment, a plurality of through holes 12 and projections 15 may be provided. In this case, the through holes 12 and projections 15 are preferably lined up along the longitudinal direction of the flat plate parts 8 and 14, respectively.

In the following, a terminal fitting according to the fourth preferred embodiment of the present invention is explained with reference to FIGS. 15-21.

Figure 16:
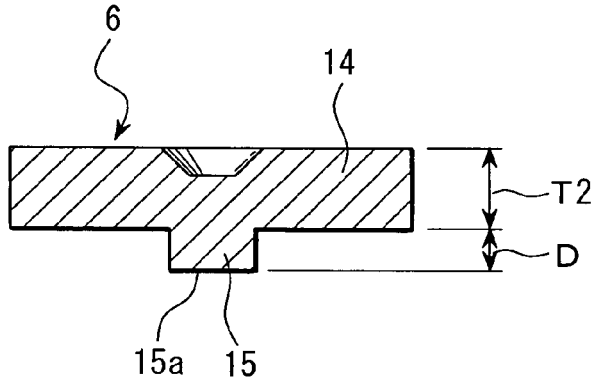
FIG. 16 is a cross sectional view of a second terminal fitting component of the terminal fitting shown in FIG. 15.
Figure 17:
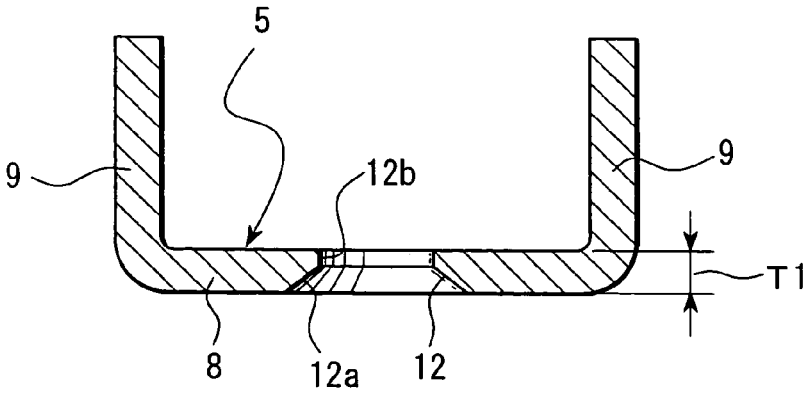
FIG. 17 is a cross sectional view of a first terminal fitting component of the terminal fitting shown in FIG. 15.

Similarly to the third preferred embodiment, in this preferred embodiment, a tapered surface 12*a* and a parallel surface 12*b* are formed on an inner peripheral surface of a through hole 12 and, as shown in FIGS. 16 and 17, an inner diameter of the through hole 12 is made larger than an outer diameter of a projection 15 before formation of an enlarged part 18. In this preferred embodiment, a projection length D (see FIG. 16) of the projection 15 from the second flat plate 14 is formed to be equal to a thickness T1 (see FIG. 17) of the first flat plate 8.

Figure 18:
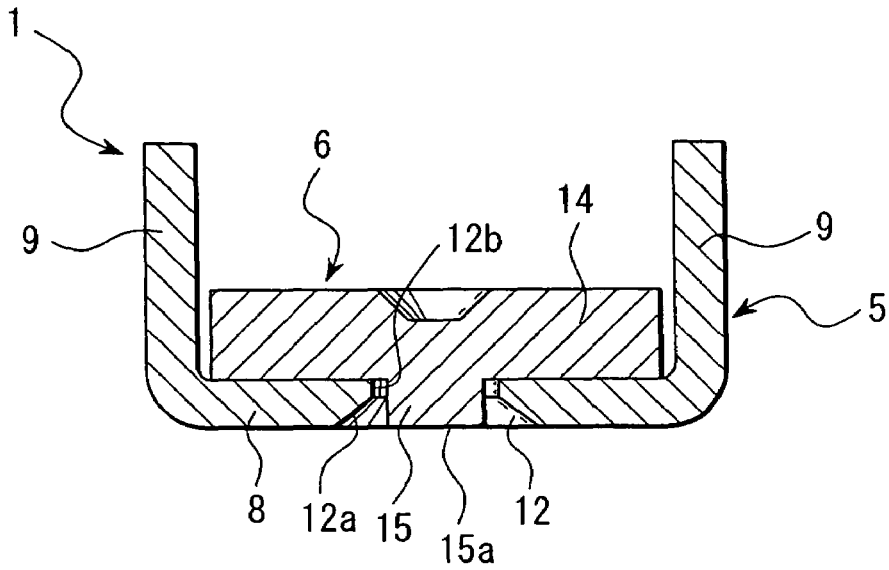
FIG. 18 is a cross sectional view illustrating a state when an enlarged part before formation of an enlarged part of the terminal fitting shown in FIG. 15 is inserted in a through hole.
Figure 19:
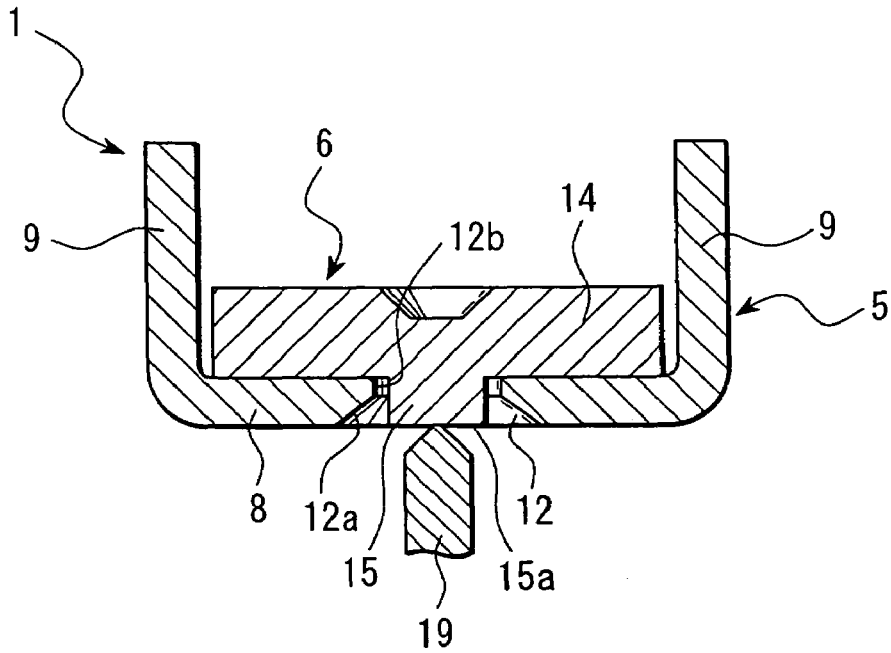
FIG. 19 is a cross sectional view illustrating a state when a pressing jig comes in contact with an end surface of an end part of the projection of the terminal fitting shown in FIG. 15.
Figure 20:
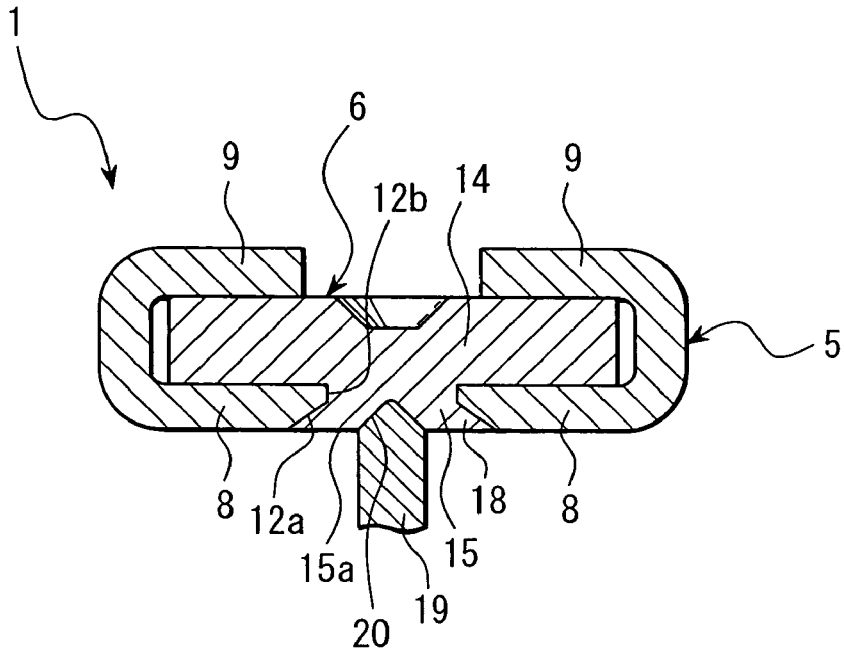
FIG. 20 is a cross sectional view illustrating a state when an end part of the projection is crushed by bending a caulking piece with the pressing jig shown in FIG. 19.
Figure 21:
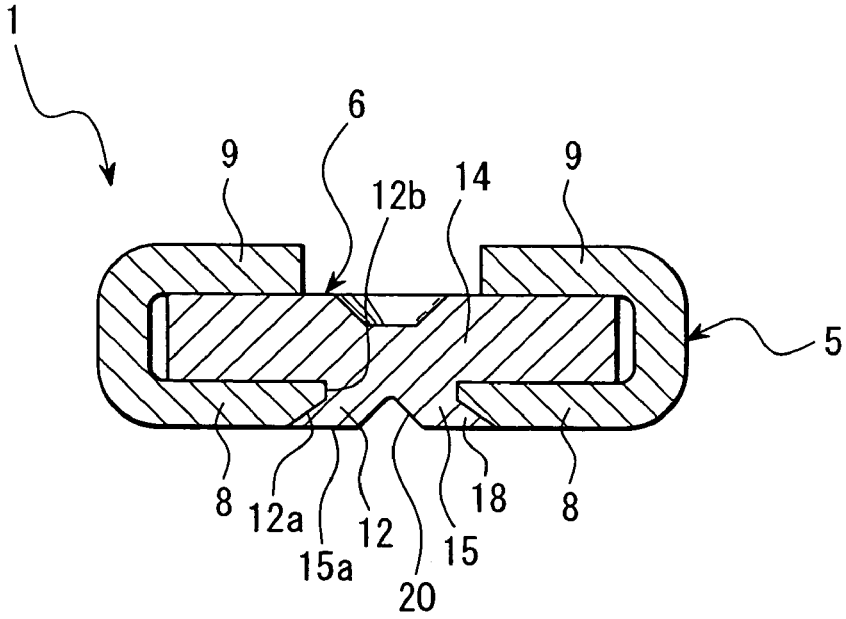
FIG. 21 is a cross sectional view of the terminal fitting shown in FIG. 20.

Further, in this preferred embodiment, as shown in FIG. 18, the projection 15 before formation of the enlarged part 18 is inserted into the through hole 12 and thereafter, as shown in FIG. 19, a rod-shaped pressing jig 19 is made come in contact with a center of an end surface 15*a* of an end part of the projection 15. Then, as shown in FIG. 20, the center of the end surface 15*a* is pressed toward the second flat plate 14 and crushed with the pressing jig 19 so that a recess 20 on the end surface 15*a* as well as the enlarged part 18 are formed and the second flat plate 14 is caulked with caulking pieces 9. Thus, as shown in FIG. 21, the terminal fitting components 5 and 6 are fixed to each other, thereby assembling the terminal fitting 1.

According to this preferred embodiment, in addition to the effect of the first preferred embodiment, since the recess 20 on the end surface 15*a* as well as the enlarge part 18 are formed by pressing the center of the end surface 15*a* of the end part of the projection 15 before formation of the enlarged part 18, therefore the enlarged part 18 more securely adheres to the tapered surface 12*a*. Therefore, an electric resistance between the terminal fitting components 5 and 6 fixed to each other can be reduced. Further, since the first flat plate 8 can be more firmly held between the enlarged part 18 and the second flat plate 14, therefore the terminal fitting components 5 and 6 can be more firmly fixed to each other.

Similarly to the second and third preferred embodiments, in this preferred embodiment, a plurality of through holes 12 and projections 15 may be provided. In this case, the through holes 12 and projections 15 are preferably lined up along the longitudinal direction of the flat plate parts 8 and 14, respectively.

In this preferred embodiment, the projection length D is made equal to the thickness T1. However, instead, in the present invention, the projection length D may be made larger than the thickness T1 or, alternatively, the projection length D may be made a little larger or a little smaller than the thickness T1. Further, in this preferred embodiment, the inner diameter of the through hole 12 may be made equal to the outer diameter of the projection 15.

In this specification, that the projection length D is approximately equal to the thickness T1 means that the projection length D is equal to the thickness T1 or, alternatively, that a difference between the projection length D and the thickness T1 is sufficiently smaller than the projection length D and the thickness T1. Thus, in the present invention, the projection length D may be approximately equal to the thickness T1.

In the present invention, the inner peripheral surface of the through hole 12 may not be provided with the tapered surface 12*a*. That is, in the present invention, at least one caulking piece 9 may be provided, so that the caulking piece 9 stands up from an edge in the width direction of the first flat plate 8.

Further, the tapered surface 12*a* may be formed on a portion of the inner peripheral surface of the through hole 12 instead of being formed over the whole of the inner peripheral surface of the through hole 12. Furthermore, three or more through holes 12 and projections 15 may be provided. The through hole 12 is preferably formed in a thin terminal fitting component, while the projection 15 is preferably formed on a thick terminal fitting component.

The aforementioned preferred embodiments are described to aid in understanding the present invention and variations may be made by one skilled in the art without departing from the spirit and scope of the present invention.

What is claimed is:

1. A terminal fitting comprising:

a first terminal fitting component having a first flat plate; and a second terminal fitting component having a second flat plate;

wherein the first and second terminal fitting components are fixed to each other on a condition that the first and second flat plates are placed one upon another, the first flat plate having a through hole, and the second flat plate having a solid projection protecting from the second flat plate, the solid projection being inserted in the through hole, wherein an enlarged part is formed by crushing an end part of the inserted solid projection toward the second flat plate, so that the enlarged part comes in close contact with walls forming the through hole and the entire solid projection, so crushed, is contained within the through hole, so as to prevent the enlarged part from coming into contact with any other article, and the enlarged part completely fills the through hole, and the first flat plate is held between the enlarged part and the second flat plate;

wherein an inner surface of the through hole is provided with a tapered surface inclined in a direction in which the through hole is gradually enlarged in a direction away from the second flat pate placed on the first flat plate, wherein the inner surface of the through hole is further provided with a parallel surface that is located nearer to the second flat plate than the tapered surface is located, the parallel surface continuing to the tapered surface and facing with an outer peripheral surface of the solid projection before formation of the enlarged part having a distance therebetween.

2. A terminal fitting comprising:

a first terminal fitting component having a first flat plate; and a second terminal fitting component having a second flat plate;

wherein the first and second terminal fitting components are fixed to each other on a condition that the first and second flat plates are placed one upon another, the first flat plate having a through hole, and the second flat plate having a solid projection projecting from the second flat plate, the solid projection being inserted in the through hole, wherein an enlarged part is formed by crushing an end part of the inserted solid projection toward the second flat plate, so that the enlarged part comes in close contact with and the entire solid projection, so crushed, is contained within the through hole, so as to prevent the enlarged part from coming into contact with any other article, and the enlarged part completely fills the through hole, and the first flat plate is held between the enlarged part and the second flat plate;

wherein a projection length of the solid projection from the second flat plate before formation of the enlarged part is approximately equal to a thickness of the first flat plate, and a recess on an end surface of the end part of the solid projection as well as the enlarged part are formed by crushing a center of the end surface toward the second flat plate.

* * * * *